United States Patent [19]

Ellis

[11] Patent Number: 4,777,928

[45] Date of Patent: Oct. 18, 1988

[54] EFFICIENT, POLLUTION FREE, WOODBURNING FURNACE

[76] Inventor: Robert Ellis, 505 W. Bakerview Rd., #70, Bellingham, Wash. 98226

[21] Appl. No.: 94,390

[22] Filed: Sep. 8, 1987

Related U.S. Application Data

[63] Continuation of Ser. No. 890,753, Jul. 25, 1986, abandoned.

[51] Int. Cl.[4] ..... F24B 1/02; F24B 5/02; F24B 7/02; F24B 9/00

[52] U.S. Cl. ..... 126/61; 126/60; 126/72; 126/77; 126/99 A; 126/104 R; 126/112; 126/110 E

[58] Field of Search ..... 126/60, 61, 72, 77, 126/99 A, 104 R, 104 A, 110 R, 110 A, 110 AA, 110 E, 112, 114, 117

[56] References Cited

U.S. PATENT DOCUMENTS

| | | | |
|---|---|---|---|
| 617,354 | 1/1899 | Reed | 126/290 |
| 2,026,340 | 12/1935 | Bradbury | 126/72 |
| 2,810,380 | 10/1957 | Critten | 126/104 R |
| 2,862,666 | 12/1958 | Kriechbaum | 126/110 AA X |
| 4,136,662 | 1/1979 | Willson | 126/61 |
| 4,154,211 | 5/1979 | Choate | 126/60 |
| 4,180,052 | 12/1979 | Henderson | 126/108 |
| 4,202,318 | 5/1980 | DePodesta et al. | 126/110 R |
| 4,206,743 | 6/1980 | Niemela | 126/110 B |
| 4,242,078 | 12/1980 | Nelson et al. | 431/45 |
| 4,265,214 | 5/1981 | Rasmussen | 126/77 |
| 4,343,290 | 8/1982 | Flatte | 126/110 E |
| 4,485,800 | 12/1984 | Stevenson | 126/77 |

FOREIGN PATENT DOCUMENTS

| | | | |
|---|---|---|---|
| 128593 | 11/1946 | Australia | 126/72 |

*Primary Examiner*—Samuel Scott
*Assistant Examiner*—Allen J. Flanigan
*Attorney, Agent, or Firm*—Graybeal, Jensen & Puntigam

[57] ABSTRACT

A self-contained, free standing, on-demand, woodburning furnace including a firebox (52), including means to force combustion gases through a manifold (68), a hot air gathering plenum and means to selectively force feed the fire (34, 36, 38, 40, 68) and draw heated air from the furnace (8, 10, 12, 14).

5 Claims, 4 Drawing Sheets

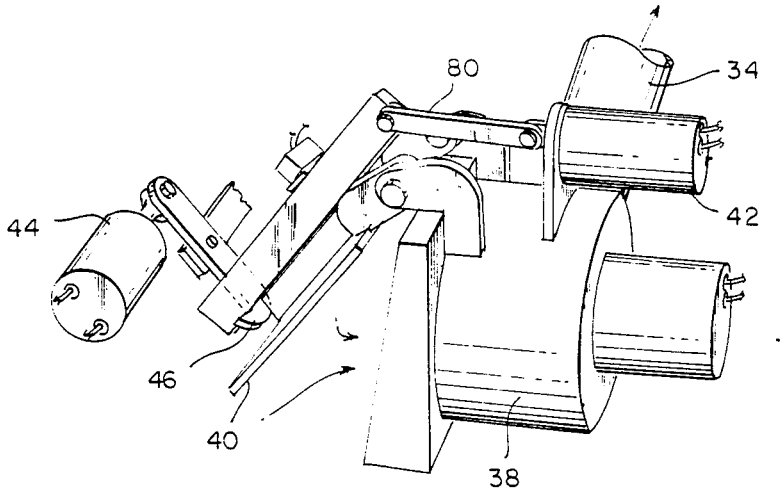
FIG. 4
FIG. 5
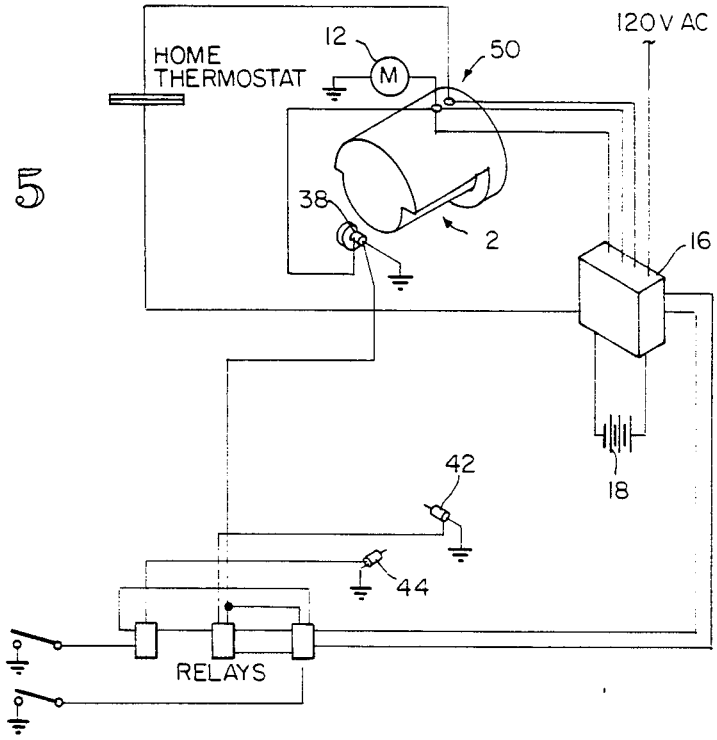

EFFICIENT, POLLUTION FREE, WOODBURNING FURNACE

This is a continuation of application Ser. No. 890,753 filed on July 25, 1986, now abandoned.

DISCLOSURE

1. Technical Field

This invention relates to a woodburning furnace and more particularly to an on-demand, efficient forced air woodburning furnace designed to be located exterior of the dwelling.

2. Background Art

It is well known that with the increased complexity of the world and the potential for an embargo upon petroleum fuels, many individuals and/or small resident or business establishments have installed a woodburning stove if not as a main source of heat at least as an emergency backup. Some of the problems that have become foremost with respect to the woodburning stoves lies in thefct that even though in some parts of the country wood is a readily available and reaonsably inexpensive commodity, the woodburning stoves are not particularly efficient, tend to primarily heat the area immediately surrounding the stove leaving other portions of the structure cold, are difficult to control from a temperature standpoint and further, tend to pollute the air with gases that have not been completely burned.

To help alleviate some of these drawbacks to woodburning stoves, manufacturers have installed fire bricks or the like as heat sinks, introduced elaborate dampers and/or airflow control devices. In addition, some manufacturers of free-standing stoves have made them double walled such that the space between the interior firebox wall and the exterior wall served as a heat plenum gathering the heated air which then can be forced into another section of the structure.

DISCLOSURE OF THE INVENTION

With the above noted prior art and inadequacies in mind, it is an object of the present invention to provide a free-standing stove which, because of the control mechanism, keep a fire banked which can be brought to life rapidly and efficiently thereby creating an on-demand woodburning stove.

It is another object of the present invention to provide a free-standing stove which is woodburning and the fire intensity is automatically controlled by temperature sensing devices.

Yet a further object of the present invention is to provide a woodburning furnace wherein the combustion is complete leaving a minimal amount of pollutants and residue.

Yet a further object of the present invention is to provide a free standing woodburning furnace wherein the extraction of the heat for use at a location separated from the furnace is extremely efficient.

Yet a further object of the present invention is to provide a free standing woodburning furnace which is capable of functioning in its full and total capacity absent of exterior source of electrical power.

BRIEF DESCRIPTION OF THE DRAWINGS

FIG. 4 is an enlarged isometric view of the airflow control mechanism.

FIG. 5 is a block diagram of the control circuitry.

BEST MODE FOR CARRYING OUT THE INVENTION

Figure 1:
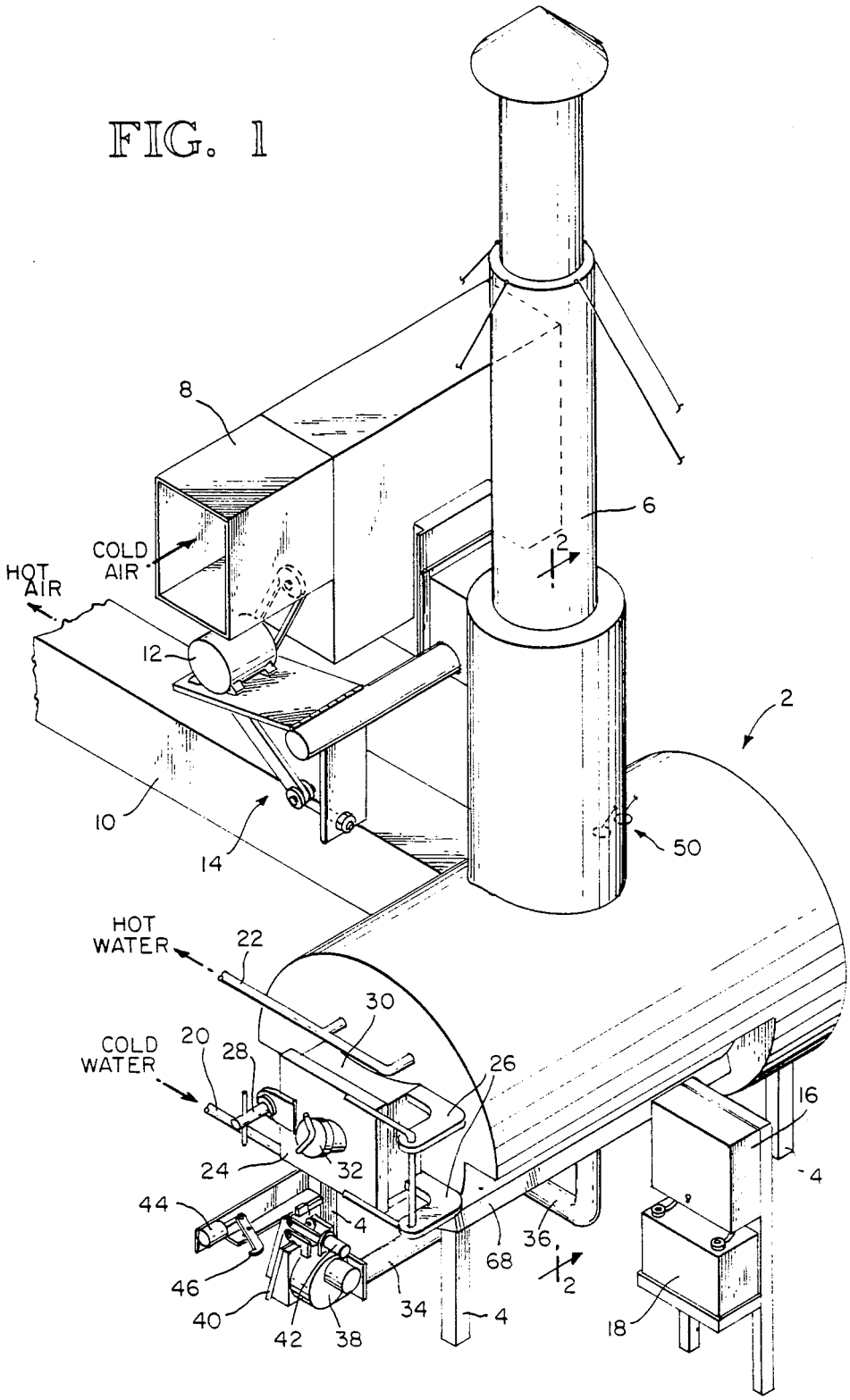
FIG. 1 is an isometric view showing the furnace in conjunction with the auxiliary gear necessary for operation.

As seen in FIG. 1, the present invention comprises an independently standing furnace generally designated as 2 and described in greater detail hereinafter supported by legs 4, and including a stack 6 for the escape of smoke and gases.

To be seen in the upper left hand portion of FIG. 1, there is located the cold air return duct 8 and the hot air supply duct 10 powered by a fan (not shown) powered by electric motor 12, suitably mounted upon mounting bracket 14. At the lower portion of this figure there can be seen the control panel 16 connected with auxiliary power source battery 18. At the front end of the firebox can be seen hot water generated by a cold water supply pipe 20 which feeds into the bottom of the firebox and a hot water return pipe 22 from the upper portion of the firebox. The interior details will be explained in detail hereinafter.

Access for supplying fuel is through door 24 having hinge members 26, threaded locking member 28, which allows the door to be tightly sealed against the outwardly projecting rectangular frame element 30.

Mounted to the outer face of the door is an airflow control element generally designed as 32 and described in greater detail hereinafter.

During the time when heat is demanded, it is supplied via the mechanism mounted generally beneath the firebox and includes a general air supply conduit 24 which, as can be seen more clearly hereinafter, has two tributaries 36 to supply air to both sides of the firebox. The air is forced through the conduits 34, 36 by blower member 38 which is actuated only when door 40 is opened by solenoid 42 and held open by temperature controled solenoid member 44 as described hereinafter. The controls for the solenoid, in the preferred embodiment, include a thermostat located in the area to be heated such that when a temperature in the area drops below a certain predesignated level, solenoid 42 is actuated opening the door 40 which is then locked in place by latch member 46 allowing a draft to the firebox. When the temperature registered at the thermostat is appropriate, solenoid 44 is actuated releasing latch member 46 and allowing the door 40 to close and simultaneously turning off the fan 38.

Auxiliary thermostatic controls are located on the upper portion of the firebox and designated generally as 50 such that if the temperature in the firebox reaches a predetermined level, the air supply door will close. This occurs no matter what the signal from the thermostat. During a period whne there is not a demand of heat from the area to be heated as indicated by the thermostat control and the firebox becomes cold enough to endanger extinguishing the fire, then the draft door 40 will be open, the blower turned on temporarily to increase the rate of combustion and restore operating temperature.

Figure 2:
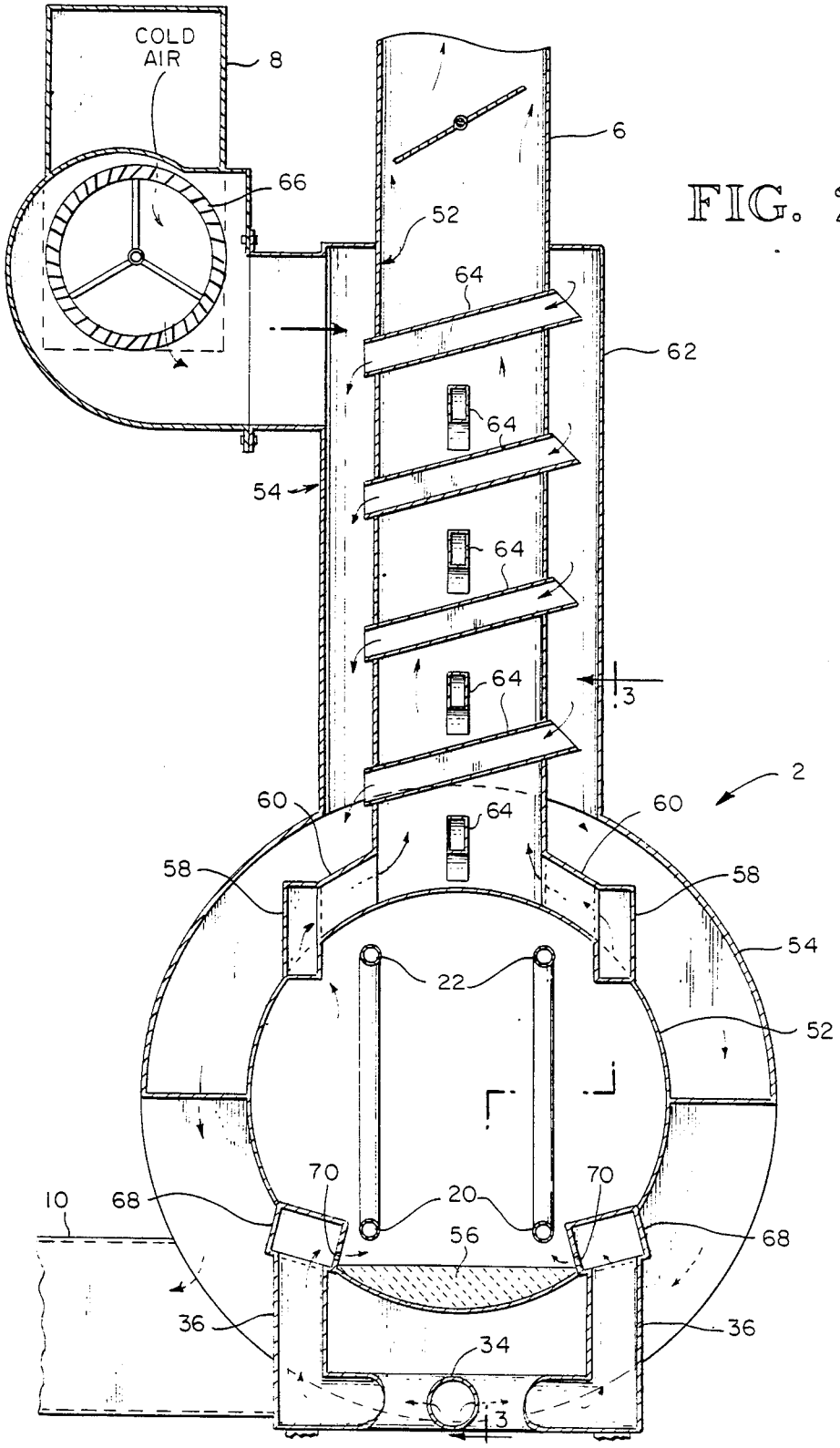
FIG. 2 is a vertical sectional view along lines 2—2 of FIG. 1.

Referring now to FIG. 2, it can be seen that the firebox generally designated as 2 includes an inner shell 52 and an outer shell 54. The inner shell 52 defines the firebox and is the actual location of combustion and includes a fire brick floor 56 and exits for the gases along the upper portion of both sides designated as 58. The gases which enter 58 through a plurality of openings exit through connecting conduit 60 to the chimney portion 6. It can be seen that the lower portion of the chimney 6 includes a jacket 62 as explained in greater detail hereinafter, and a plurality of tubes 64 open at either end and extend at a vertical angle through the chimney 6.

The cold air return duct 8 from the area to be heated is seen in the upper portion of this figure feeds into the space between the wall of the firebox 52 and the outer wall 54. Although, as seen in FIG. 1, this jacket is not totally encapsulating it does in fact encapsulate more than 70% of the firebox and forms a closed chamber to store heated air.

The air which enters into the space between the jacket or the plenum circulates downward over the stack and through the stack tubes 64 and around the heated firebox and then is forced outwardly by fan 66 and forced through the hot air duct 10 into the area to be heated.

Also to be seen in this view in the lower portion is the air supply conduit 34 feeding into tributaries 36 which are interconnected with horizontally mounted distribution element 68 having a plurality of openings 70 which allow the fueling air to be forced into the bottom of the firebox causing instant combustion.

In the interior of the firebox the cold water supply pipes 20 are seen passing horizontally through the firebox and then transforming upwardly to return to the front of the firebox via conduits 22.

Figure 3:
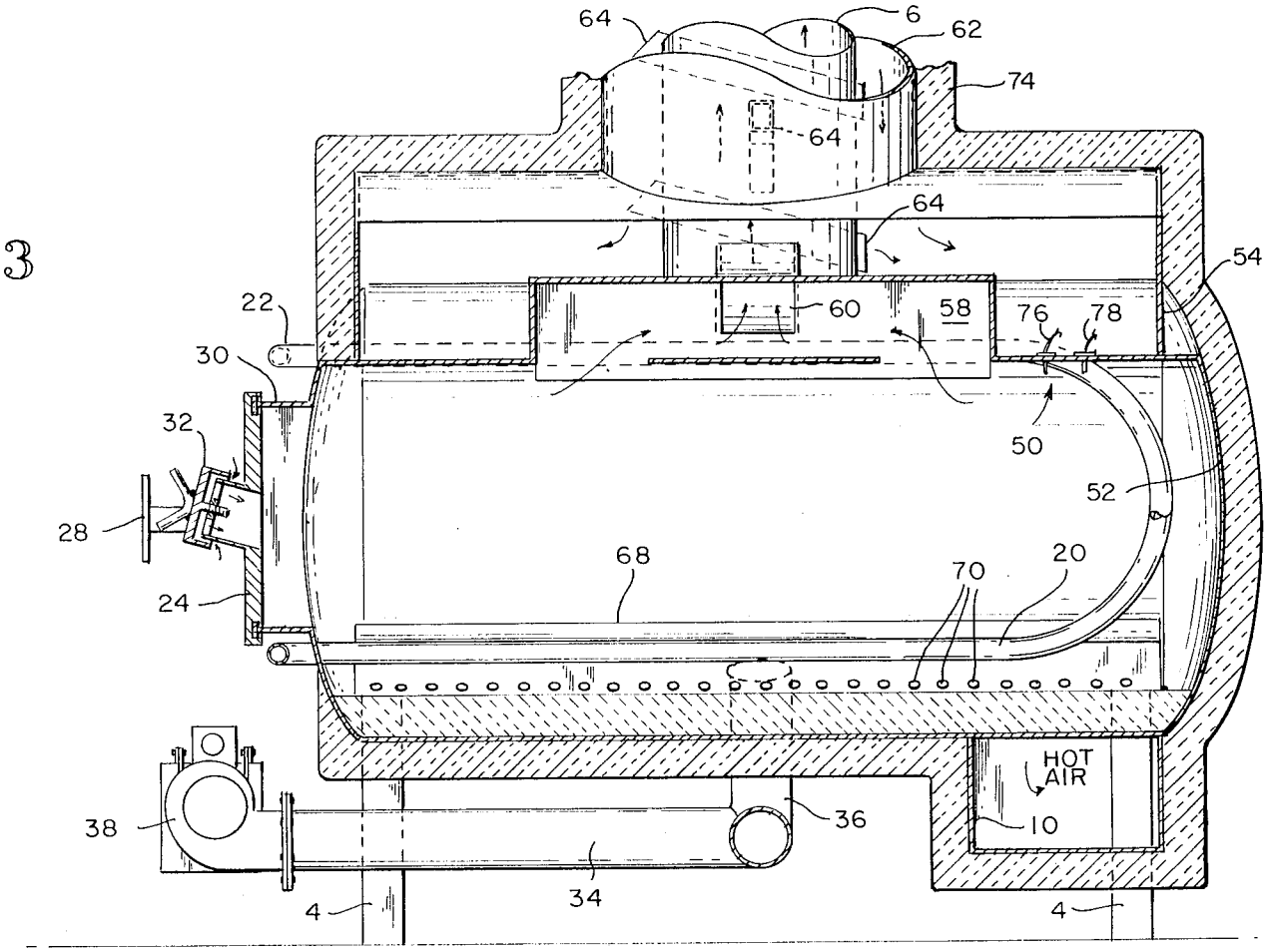
FIG. 3 is a vertical section taken along lines 3—3 of FIG. 2.

Attention is now drawn to FIG. 3 which is a section along lines 3—3 of FIG. 2. The various elements can be seen from a different direction and therefore, their interrelationship becomes more clear. As seen in this view, the cold water inlet enters through a pair of parallel pipes 20 which extend substantially the full length of the firebox immediately above the fire brick and then curve upwardly to exit via sections 22 through the front of the firebox at the top thereof. The plurality of holes 70 in the element 68 assures that air forced into the device by fan 38 via conduits 34 and 36 promotes combustion the entire length of the firebox thereby greatly improving the efficiency of the entire device. Further to be seen in this view are the interrelationship of the firebox itself, defined by shell 52, and the hot air plenum, defined by shell 54. For efficiency, the entire device including the lower part of the exhaust stack is heavily insulated as designated in this view as 74. At the upper portion of the firebox it can be seen that the exhaust gases leave the firebox via collector 58 and then are carried to the exhaust stack via conduit 60. It is to be noted that the exhaust stack 6 has passing therethrough a plurality of open ended rectangular tubes 64 to further extract heat from the escaping gases as the heated air pases therethrough.

As noted hereinabove, the air for heating the structure enters into the plenum area via cold air return 8 enters the heat exchanger 64 then down the stack and inside a shell 62 encapsulating the chimney and furnace. As stated the air flows through the various rectangular tubes 64 extracting heat.

The fuel for maintaining the fire is supplied through neck 30 closed by door 24 which is tightly sealed by a threaded fastener having a handle 28. The controlled venting for maintaining the fire at a bank condition until demand is provided by adjustable inlet valve having cap 32.

Also to be noted in this view there are a pair of thermostatic probes 76, 78 for sensing the temperature within the hot air chamber i.e. being able to determine whether or not the temperature is sufficient such that the blower moving the air into the dwelling can be started and secondly determining when the temperature in the hot air chamber is sufficiently hot so that the air being forced into the firebox to generate combustion should be shutdown. In operation even though the thermostatic control within the dwelling demands that the furnace respond it will not do so until the controls indicate there is sufficient heat in the plenum to prevent a cold draft when a blower does in fact start. A signal from the thermostat in the dwelling indicating that more heat is needed also, as explained in greater detail hereinafter, initiates the combustion cycle by opening a door to blower 38 which then forces air into the firebox the entire length thereof causing instant combustion and resultant heat to increase the temperature in the plenum allowing the air to be forced into the dwelling.

Reference is now had to FIG. 4 the mechanism permitting the efficient combustion can more readily be seen. A fan 38 draws air from the outside and forces it through conduit 34 into the firebox as explained hereinabove. A solenoid 42 acting via link 80 opens door 40 when the controls indicate the need for air. Since it is necessary to keep the door 40 in open position for extended periods of time, a latch member 46 engages the door 40 and holds it open until the controls indicate there has been enough heat generated and solenoid 44 is activated to unlatch the door allowing it to be unclosed.

It is to be understood that the majority of the controls operate on a low voltage DC via a transformer such that during a power outage, the furnace will be operated by the battery 18.

Thus, it can be seen that the present invention provides a safe, efficient means for heating an area in a comfortable and convenient manner. Substantially all of the heat is extracted from the fuel and utilized.

I claim:

1. An on-demand furnace utilizing solid fuel wherein the furnace may be placed exterior of the space to be heated greatly reducing the inherent danger of an open flame, comprising:

an elongated main combustion chamber including a selectively sealable door at one end to accommodate the introduction of fuel, and a stack, said stack primarily to remove combustion gases but including a plurality of open ended passages extending therethrough to extract heat from the combustion gases, said passages isolated from the combustion gases;

a pair of parallel combustion gas collector conduits in direct communication with the combustion chamber, said conduits located on opposite sides of the stack and extending along a substantial portion of the length of the main combustion chamber adjacent the upper portion thereof to collect the combustion gases prior to entering the stack and to retard the exit progress whereby the gases may be more fully consumed, a pair of air supply conduits extending along the lower surface and extending substantially the full length of the main combustion chamber, from the door to the opposite end wall, said air supply means including a plurality of openings along the length thereof to assure a uniform flame throughout the length of the main combustion chamber;

a first thermostatically controlled blower means interconnected to the air supply conduits whereby the intensity of the flame is controlled by operation of the blower;

a thermostat located adjacent the main combustion chamber to control the first blower means;

damper means automatically closing the air supply means when the blower means is not in operation;

vent means for supplying a sufficient amount of air to keep the fire from dying when the blower is not in operation;

plenum means substantially surrounding the combustion chamber and the lower portion of the stack for collecting heated air in communication with the passages through the stack;

a second thermostatically controlled blower means for circulating the heated air downwardly, around and through the stack and then to the space to be heated; and a thermostat located within the space to be heated to control the second blower means; whereby upon demand, a flame is kindled, air is heated in the plenum and forced to the space to be heated.

2. An on-demand furnace as in claim 1, wherein the operating circuit is 12 V and includes an auxiliary battery to maintain operation during power outages.

3. An on-demand furnace as in claim 1, wherein the air to be heated is introduced adjacent the stack and withdrawn from adjacent the bottom of the plenum.

4. An on-demand furnace as in claim 3, wherein the air to be heated passes through tubes extending through the stack.

5. An on-demand furnace as in claim 1, wherein the damper is controlled by solenoid means

* * * * *